United States Patent [19]

Frestad

[11] 4,226,305

[45] Oct. 7, 1980

[54] ROPE DESCENT CONTROL-BRAKE

[76] Inventor: Finn Frestad, Floyveien 4, N-4440 Flekkefjord, Norway

[21] Appl. No.: 961,490

[22] Filed: Nov. 17, 1978

[30] Foreign Application Priority Data

Nov. 29, 1977 [NO] Norway ..... 774003
Jun. 28, 1978 [NO] Norway ..... 782228

[51] Int. Cl.[2] ..... B65H 59/26

[52] U.S. Cl. ..... 188/65.2; 182/5; 188/65.4

[58] Field of Search ..... 188/65.1, 65.2, 65.3, 188/65.4, 65.5; 182/5, 6, 7, 72, 133, 134, 135, 136, 192, 193

[56] References Cited

U.S. PATENT DOCUMENTS

| | | | |
|---|---|---|---|
| 469,239 | 2/1892 | Gardner | 188/65.4 |
| 1,441,806 | 1/1923 | Hoitsma | 182/136 |
| 2,034,841 | 3/1936 | Staggers | 188/65.2 |
| 2,758,887 | 8/1956 | Herod | 188/65.2 |

FOREIGN PATENT DOCUMENTS

| | | | |
|---|---|---|---|
| 233010 | 8/1908 | Fed. Rep. of Germany | 182/72 |
| 1021541 | 2/1953 | France | 182/7 |
| 15707 | of 1886 | United Kingdom | 188/65.2 |
| 891058 | 3/1962 | United Kingdom . | |

*Primary Examiner*—Edward R. Kazenske
*Attorney, Agent, or Firm*—Young & Thompson

[57] ABSTRACT

A rope descent control-brake is in three hingedly interconnected parts with springs at the hinges to urge the parts toward extended condition. Each part has a hole through it, and the rope is threaded in sinuous fashion through the three holes. In extended position, the device acts as a brake; while in collapsed position, the rope can be freely moved through the holes. A further lever assembly can be pivoted intermediate its length to the free end of one of the parts, and a handle can be pivotally mounted on a free end of the lever assembly and provides a control for the speed of descent.

5 Claims, 8 Drawing Figures

ROPE DESCENT CONTROL-BRAKE

The present invention relates to control-brakes for safety ropes used by persons working on a sloping surface such as a pitched roof, a rockface, etc. In such circumstances, a safety rope secured to a permanent anchorage point above is often used. The worker either holds on to or ties himself to the rope, often resulting in his being inadequately secured against falling by the rope.

Persons working on a sloping surface often find it difficult to hold on to the rope whilst working, and it is often impractical for the person to tie himself to the rope as this means he has to untie and re-tie himself every time he wishes to move up or down the slope. Persons working on a sloping surface often show carelessness when it comes to securing themselves to the rope and serious injury or death may result from falling.

It is well known to apply control-brakes or fail-safe devices to safety ropes. These devices are adjustable braking devices or fail-safe devices which lock on to the rope when the rope is pulled sharply.

Known control-brakes or fail-safe devices suffer from several weaknesses. In particular, the fact that known devices are of cylindrical design and the rope passes through the device involves a considerable danger of the device not functioning under certain circumstances such as ice accumulating on the rope or foreign matter such as sand, chippings, etc. falling into the cylinder causing it to malfunction.

Another weakness is the fact that known devices often depend on the action of steel springs in order to function at all. In the case of such springs breaking or for some other reason failing to function adequately the device is rendered inoperable and the rope is usually allowed to pass freely through the device.

Known control-brakes or fail-safe devices are often of complicated design and therefore expensive to produce.

The present invention provides a simple and safe control-brake without the above-mentioned weaknesses whilst also being simple and inexpensive to manufacture.

According to the invention the control-brake comprises preferably three parts hinged together so as to form a three-part hinge, each of the said parts having a hole of such size as to suit the thickness of the safety-rope. The person descending the slope attaches himself to one of the said parts by known means using a safety harness.

When moving up or down the slope the control-brake is easily moved along the rope in either direction. If, however, the person should fall or pull the part to which he is attached, the device immediately locks tightly on to the rope preventing him from falling even if the rope is covered with ice, oil, etc.

The control-brake may according to the invention also be used for vertical rope-descent such as when using fire escape rope and is then operated in the same manner as when descending a sloping surface.

Three preferred embodiments of the invention will now be described by way of example with reference to the accompanying drawings in which.

Figure 1:
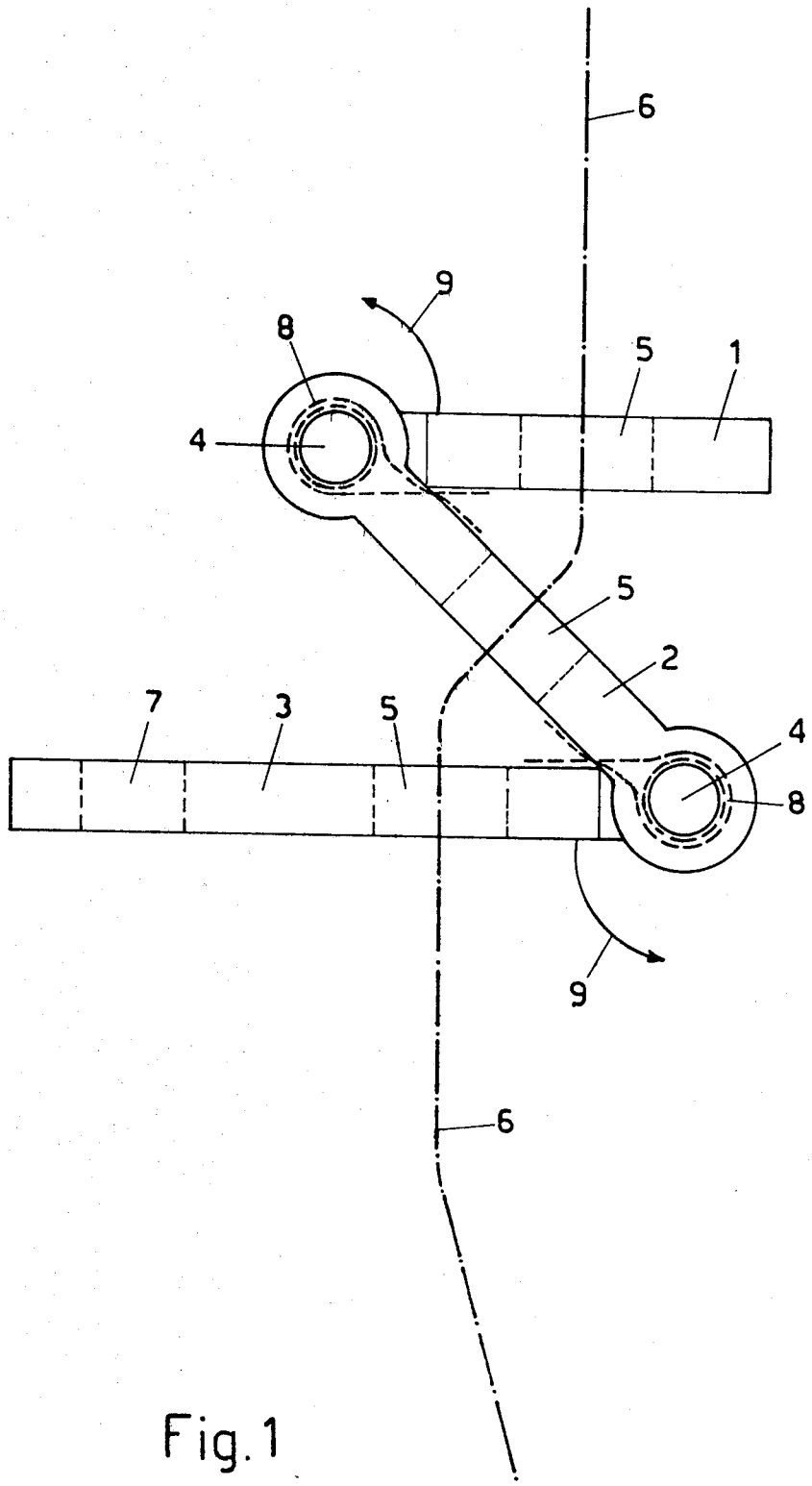
FIG. 1 shows a side view of the control-brake in such a position as to allow vertical movement along the rope.

Referring to the drawings, the control-brake consists of three hinge parts, an upper part 1, a middle part 2, and a lower part 3, the three parts being joined via knuckles by means of bolts 4. Each part 1, 2, 3 has a hole 5 through which the rope 6 is passed. The thickness of rope 6 naturally depends on the strength of the rope, 15 to 18 mm being a usual thickness. The lower part 3 has a second hole 7 to allow for the attachment of harness 10 shown in FIG. 2. Steel springs 8 indicated by broken lines in FIGS. 1, 2, 6 and 7 may be fitted around to the two bolts 4 and extend onto the adjacent parts in order to provide additional assurance that the control-brake moves quickly to the locking position shown in FIG. 2. The device does not however rely on the action of the springs in order to function satisfactorily.

Figure 2:
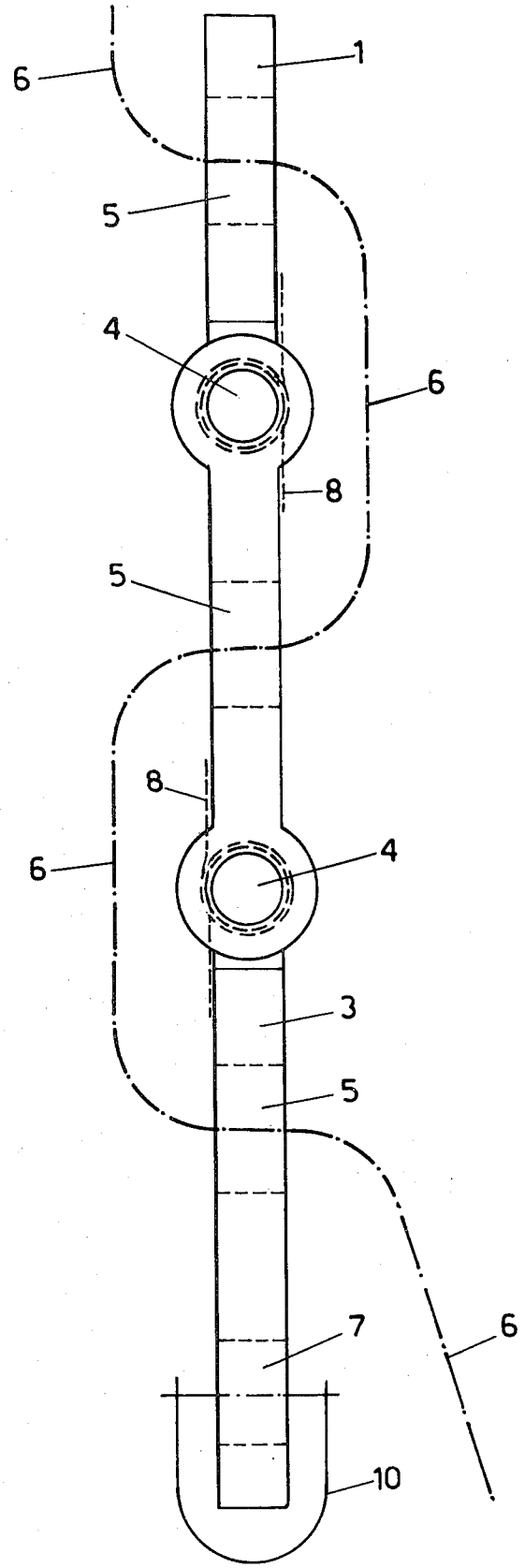
FIG. 2 shows a side view of the control-brake in such a position as to prevent movement along the rope.

FIG. 1 shows the control-brake in such a position as to allow vertical movement along the rope. The said springs 8 will as soon as the control-brake is released cause it to extend in the direction of arrows 9 so that the control-brake quickly assumes the extended position shown in FIG. 2. In its extended position the control-brake prevents the rope 6 from passing through the holes 5 in parts 1, 2, and 3. A person attached to the control-brake's lower part 3 by means of harness 10 will not need to attend to the control-brake other than when moving it along the rope 6.

Figure 3:
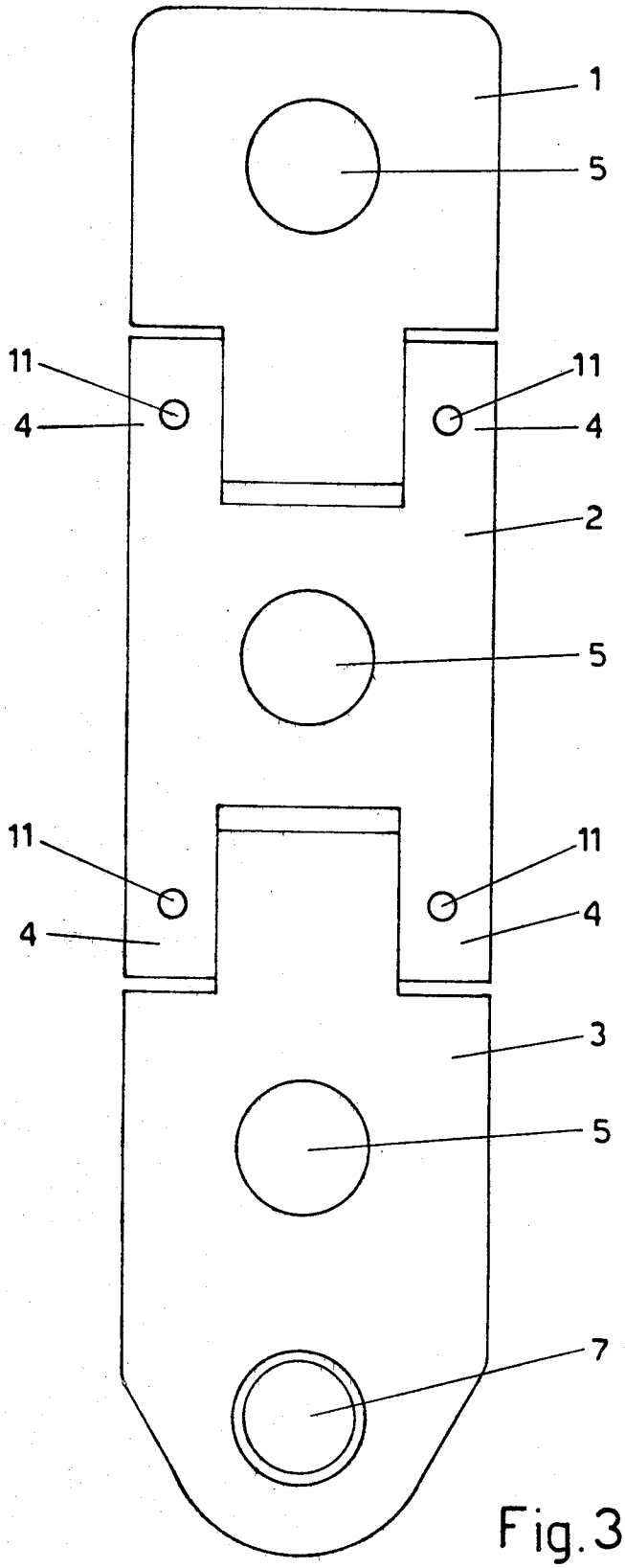
FIG. 3 shows a front view of the control brake.

FIG. 3 indicates how the bolts 4 may be secured using set screws 11 or some other fastening device.

Figure 4:
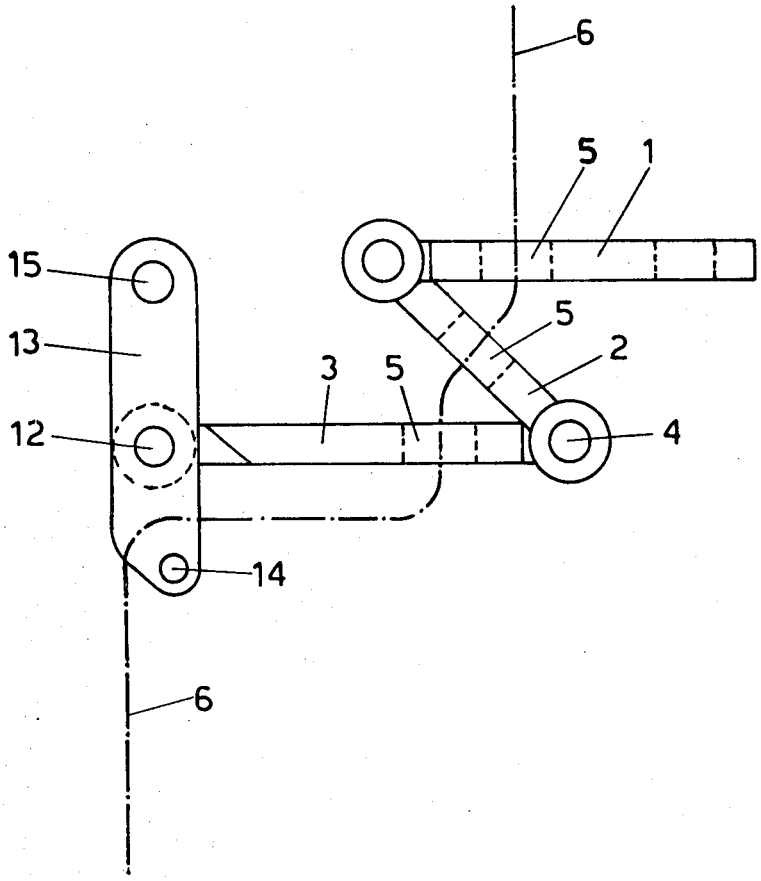
FIGS. 4 and 5 show a modified version of the invention.
Figure 5:
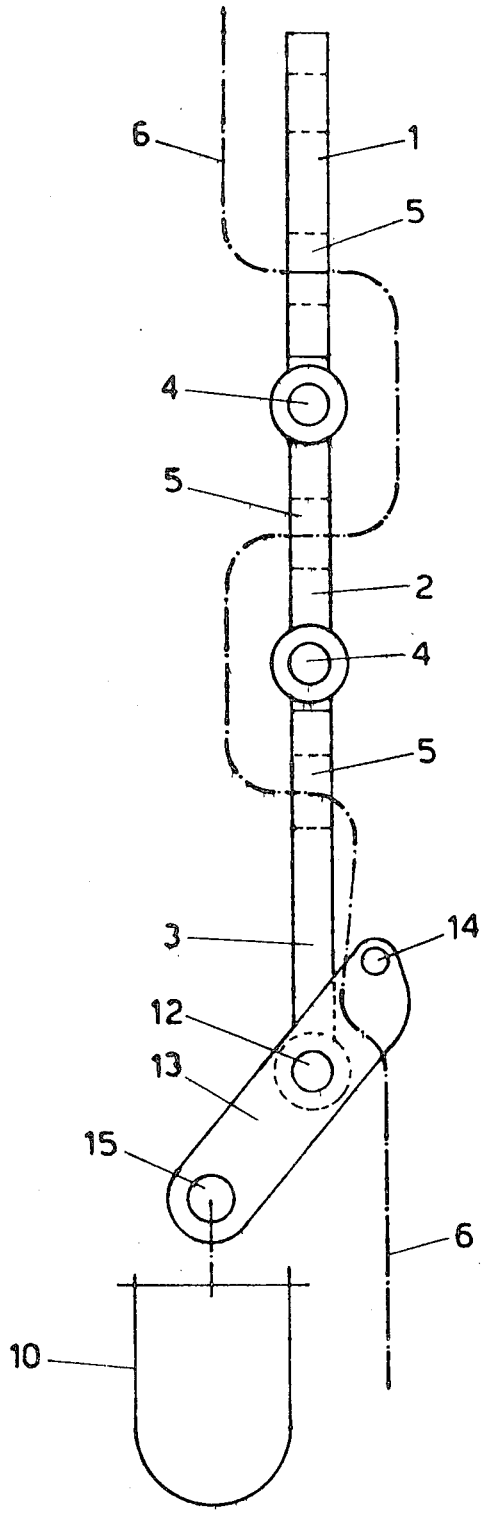

FIGS. 4 and 5 show a somewhat modified version of the invention wherein the lower part 3 has attached to it a pair of levers 13 which are firmly joined together by means of a bolt 14 at one end and a bracket 15 at the other end to which the harness 10 is attached, and said pair of levers pivots in the same plane as the hinged parts 1, 2 and 3 around a mounting point 12 at the lower end of the lower part 3.

As FIG. 5 clearly illustrates, the pair of levers 13 provides a further means of preventing the rope from passing through the control-brake in that when harness 10 is subjected to downward force the connecting bolt 14 traps the rope 6 firmly against the lower part 3. In this modified version the control-brake is completely safe even if the rope 6 is not of a suitable thickness in relation to the holes 5 or is covered with oil, etc.

Figure 6:
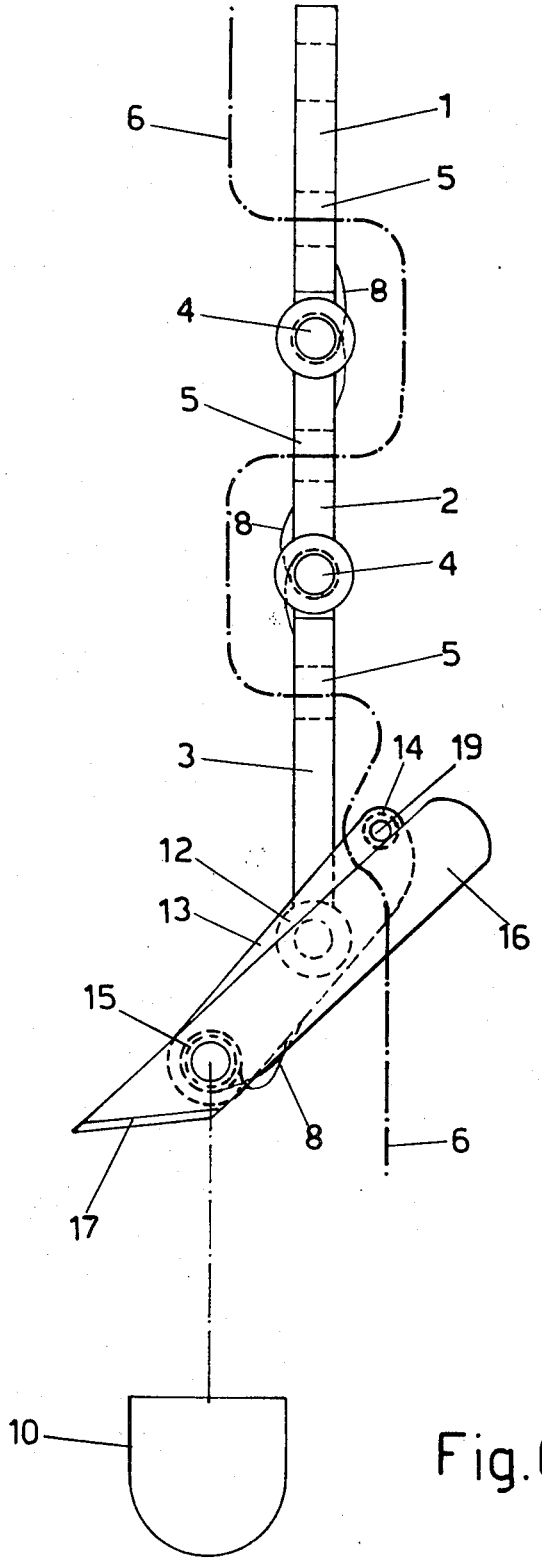
FIGS. 6, 7 and 8 show a further modification of the invention.
Figure 7:
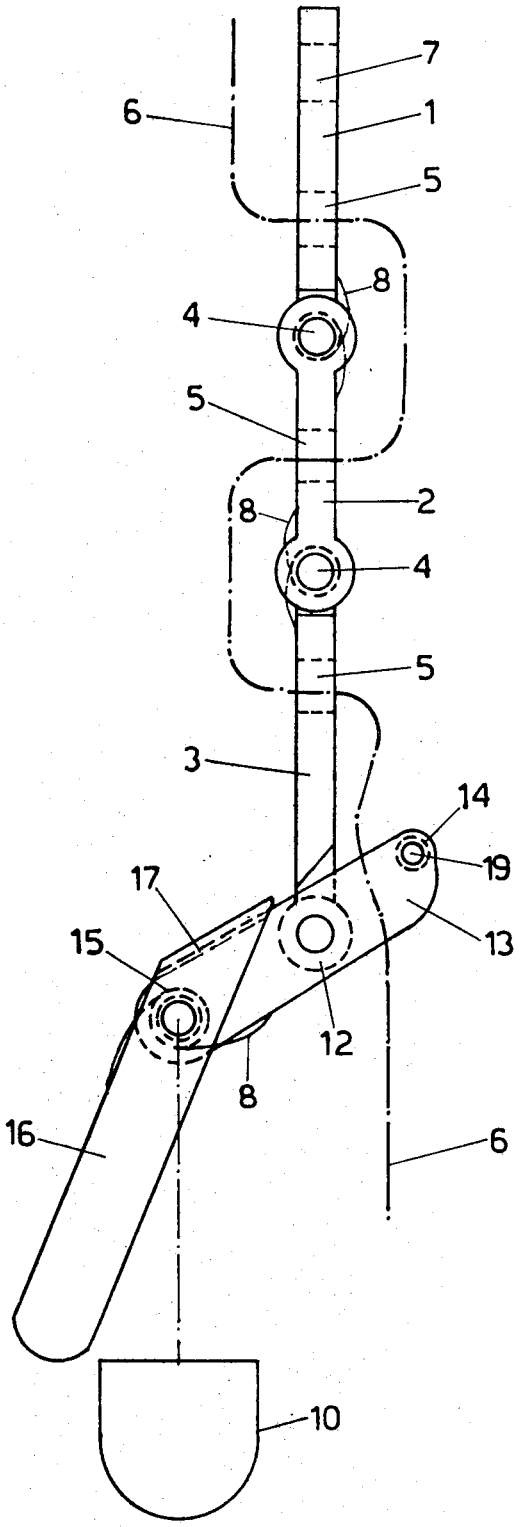
Figure 8:
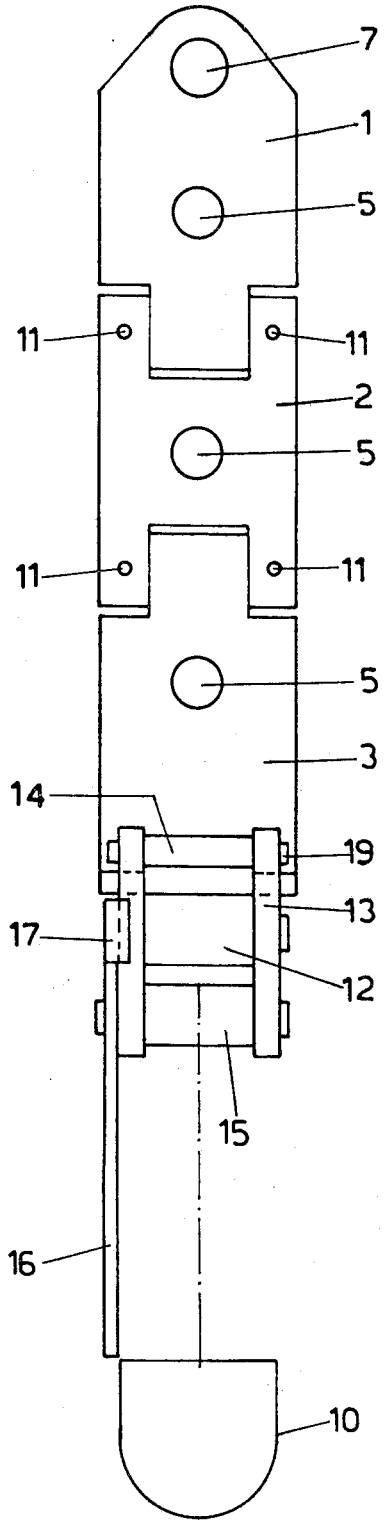

FIGS. 6, 7 and 8 show a further development of the invention wherein the lever-assembly 13 is extended by means of a handle 16 which pivots around a bolt 15 to which the harness 10 is attached. Th handle 16 incorporates a stop 17 which limits the movement of the handle 16 in relation to the lever-assembly 13 in that the stop 17 will be brought to rest against the lever-assembly 13 as the handle 16 is swung clockwise around its pivot 15 as shown in FIG. 7. In this position, the handle 16 acts as an extension of one arm of the lever-assembly 13, and by pulling the handle 16 clockwise as seen in FIG. 7, a person suspended in the harness 10 will be able to rotate the lever-assembly 13 clockwise as seen in FIG. 7 around its pivot 12 so as to reduce the pressure exerted on the rope 6 by the bolt 14 and the hinged part 3. The person will thus be able to slide down the rope 6 provided that the holes 5 in the parts 1, 2 and 3 are relatively large in relation to the diameter of the rope 6.

The purpose of this further development of the invention is to provide a control-brake which allows a person suspended in the harness 10 to slide down the rope at a controlled speed. If the speed is too high the person simply pulls the handle 16 less hard, thus allowing the lever-assembly 13 to rotate slightly counterclock so as to increase the pressure exerted on the rope 6 by the bolt 14 and the part 3, thereby to reduce the speed at which the rope 6 is able to pass through the control-brake. When the person wishes to stop sliding completely, he simply lets go of the handle 16, and the control-brake locks firmly on to the rope 6.

Another further development of the invention incorporates a spring 18 which causes the handle 16 to rotate from the operational position where it forms an extension of one arm of the lever-assembly 13 to a rest position approximately parallel to the lever-assembly 13. In its rest position the handle rests against a pin 19 which extends from the bolt 14 as shown in FIG. 6.

The control-brake may, of course, be made in many different sizes, including very small sizes suitable for the tensioning of guy ropes, hammocks, etc.

What I claim is:

1. Rope descent control-brake which is movable along a rope and which locks firmly on to the rope when pulled, the rope descent control-brake comprising an upper part, a middle part, and a lower part, said upper part being hinged to said middle part by hinge-joint and said middle part being hinged to said lower part by a hinge-joint for swinging movement relative to each other about horizontal axes and each part having a hole through which the rope is passed, said holes being horizontal and perpendicular to the axes about which said parts are hinged when said parts are vertically aligned, and the lower part having an anchorage point for a safety-harness, springs mounted on the hinge-joints between said parts in such a manner as to cause said parts to move into the vertically aligned position as soon as the parts are released following a movement along the rope and thus providing further assurance that the control-brake locks on to the rope quickly and safely.

2. Rope descent control-brake as claimed in claim 1 wherein the lower part is joined to a lever-assembly by means of a hinge-joint, said lever-assembly having a connecting bolt at one end that contacts the rope and a connecting bracket which also serves as an anchorage point for the harness at the other end.

3. Rope descent control-brake as claimed in claim 2 wherein the bracket of the lever-assembly on to which the harness is attached is extended by means of a handle for swinging the lever-assembly about said hinge-joint to vary the pressure of the connecting bolt on the rope.

4. Rope descent control-brake as claimed in claim 3 wherein said handle pivots around the point at which it is attached to the lever-assembly so that it may be rotated from its operational position where it forms an extension of the lever-assembly, to a rest position which is aproximately parallel to the lever-assembly.

5. Rope descent control-brake as claimed in claim 4 wherein the handle is spring loaded so as to return to said rest position after use.

* * * * *